US008373578B1

(12) United States Patent
Sikora et al.

(10) Patent No.: US 8,373,578 B1
(45) **Date of Patent: *Feb. 12, 2013**

(54) WIRELESS HEAD FOR A TRAFFIC PREEMPTION SYSTEM

(75) Inventors: Scott T. Sikora, Gilbert, AZ (US); David Gerard Worthy, Gilbert, AZ (US); Timothy A. Geiger, Gilbert, AZ (US)

(73) Assignee: Tomar Electronics, Inc., Gilbert, AZ (US)

( * ) Notice: Subject to any disclaimer, the term of this patent is extended or adjusted under 35 U.S.C. 154(b) by 986 days.

This patent is subject to a terminal disclaimer.

(21) Appl. No.: 12/417,558

(22) Filed: Apr. 2, 2009

(51) Int. Cl.
*G08G 1/07* (2006.01)

(52) U.S. Cl. ..... 340/906; 340/901; 340/902; 340/904; 340/905; 340/907; 340/917

(58) Field of Classification Search ..... 340/901, 340/902, 904, 905, 906, 907, 917
See application file for complete search history.

(56) References Cited

U.S. PATENT DOCUMENTS 5,172,113 A 12/1992 Hamer
5,926,113 A 7/1999 Jones et al.
5,986,575 A 11/1999 Jones et al.
6,243,026 B1 6/2001 Jones et al.
6,909,380 B2 6/2005 Brooke
6,940,422 B1 9/2005 Bachelder et al.
7,098,806 B2 8/2006 Bachelder
8,054,202 B1 * 11/2011 Sikora et al. ..... 340/906
2006/0273923 A1 12/2006 Schwartz
2006/0273924 A1 12/2006 Schwartz
2006/0273925 A1 12/2006 Schwartz
2006/0273926 A1 12/2006 Schwartz
2007/0008173 A1 1/2007 Schwartz
2007/0008174 A1 1/2007 Schwartz

* cited by examiner

*Primary Examiner* — Daryl Pope
(74) *Attorney, Agent, or Firm* — Booth Udall, PLC

(57) ABSTRACT

A wireless head for a traffic preemption system. Implementations may include one or more optical receivers adapted to identify an optical signal transmitted by an optical transmitter included in a vehicle preemption unit mounted to a vehicle and one or more head radio transceivers adapted to identify a radio signal transmitted by a vehicle radio transceiver included in the vehicle preemption unit. A head radio frequency (RF) modem may also be included adapted to transmit one or more radio signals to an intersection RF modem. The head may be mounted to a traffic support fixture. The one or more optical receivers, one or more head radio transceivers, and the head RF modem may all be operably coupled together within the wireless head. The intersection preemption unit may be adapted to change a traffic light in favor of the vehicle to which the vehicle preemption unit is mounted.

30 Claims, 6 Drawing Sheets

WIRELESS HEAD FOR A TRAFFIC PREEMPTION SYSTEM

BACKGROUND

1. Technical Field

Aspects of this document relate generally to traffic preemption systems for use with emergency and other vehicles.

2. Background Art

Traffic preemption systems are conventionally used to permit emergency and other vehicles to change a traffic light that is initially red at an intersection to green prior to their arrival. With the light in the vehicle's favor, the vehicle does not need to wait or to drive on the opposite side of the street to avoid stopped vehicles at the light. In addition, conventional traffic preemption systems have been used to aid public transportation vehicles, such as buses, to maintain headway relative to other vehicles during high traffic periods. Some conventional preemption systems also contain functionality that allows prioritization of the movement of an emergency vehicle over a public transportation vehicle through an intersection.

SUMMARY

First implementations of wireless heads disclosed in this document may include one or more optical receivers adapted to identify an optical signal transmitted by an optical transmitter included in a vehicle preemption unit mounted to a vehicle and one or more head radio transceivers adapted to identify a radio signal transmitted by a vehicle radio transceiver included in the vehicle preemption unit. A head radio frequency (RF) modem may also be included adapted to transmit one or more radio signals corresponding with the optical signal, the radio signal, or a combination of the optical signal and the radio signal to an intersection RF modem included in an intersection preemption unit coupled with an intersection system controller. The head may be mounted to a traffic support fixture. The one or more optical receivers, one or more head radio transceivers, and the head RF modem may all be operably coupled together within the wireless head. The intersection preemption unit may be adapted to change a traffic light in favor of the vehicle to which the vehicle preemption unit is mounted in response to the optical signal, the radio signal, or the combination of the optical signal and the radio signal from the vehicle preemption unit.

First implementations of wireless heads may include one, all, or any of the following:

A battery may be included adapted to provide substantially all the power to operate the wireless head.

The wireless head may further include a solar panel coupled with the wireless head where the solar panel is adapted to supply a portion of the power to operate the wireless head.

The wireless head may include one or more wakeup optical receivers coupled with a wakeup circuit including a wakeup controller where the one or more wakeup optical receivers are adapted to identify and receive the optical signal and the wakeup controller is adapted to transmit a wakeup signal when the optical signal is identified. One or more wakeup radio receivers may be coupled with the wakeup circuit where the one or more wakeup radio receivers are adapted to identify and receive the radio signal and the wakeup controller is adapted to transmit a wakeup signal when the radio signal is identified. A head controller may be coupled with the wakeup circuit and the one or more wakeup optical receivers and the one or more wakeup radio receivers. The head controller may be adapted to enter an operating state from a low power state in response to receiving the wakeup signal from the wakeup controller. The head controller may also include a signal processor and a signal decoder where the signal processor is adapted to condition and process the optical signal and the radio signal and the signal decoder is adapted to determine the presence of the optical signal and the radio signal or to decode the optical signal and the radio signal to produce information relating to the vehicle.

The wireless head may include a wakeup circuit coupled with the one or more optical receivers. The wakeup circuit may include a wakeup controller and the one or more optical receivers and the wakeup circuit may be adapted to identify and receive the optical signal and to transmit a wakeup signal when the optical signal is identified. The wakeup circuit may be coupled with the one or more radio receivers and the one or more radio receivers and the wakeup circuit may be adapted to identify and receive the radio signal and to transmit a wakeup signal when the radio signal is identified. A head controller may be coupled with the wake up circuit and the one or more optical receivers and the one or more radio receivers. The head controller may be adapted to enter an operating state from a low power state in response to receiving the wakeup signal from the wakeup controller. The head controller may include a signal processor and a signal decoder where the signal processor is adapted to condition and process the optical signal and the radio signal and the signal controller is adapted to determine the presence of the optical signal and the radio signal or to decode the optical signal and the radio signal to produce information relating to the vehicle.

The wireless head may include a red light sensor coupled with the wireless head where the red light sensor is adapted to detect when a red light included in a traffic light mounted on the traffic support fixture is illuminated.

A temperature sensor, a light level sensor, a wind speed sensor, a humidity sensor, and any combination thereof may be coupled with the wireless head.

The wireless head may include at least a second wireless head adapted to receive the optical signal and the radio signal and to calculate a distance of the vehicle from an intersection by triangulating using the optical signal, the radio signal, or a combination of the optical signal and the radio signal.

The wireless head may further include at least a second optical receiver or a second head radio transceiver adapted to receive the optical signal or the radio signal, respectively, and to calculate a distance of the vehicle from an intersection by triangulating using the optical signal or the radio signal.

Second implementations of a wireless head may include a wakeup optical receiver adapted to identify an optical signal transmitted by an optical transmitter included in a vehicle preemption unit mounted to a vehicle. The optical receiver may be coupled with a wakeup circuit including a wakeup controller. A preemption optical receiver may be included adapted to receive the optical signal from the optical transmitter of the vehicle preemption unit. A head radio frequency (RF) modem may also be included adapted to transmit one or more radio signals corresponding with the optical signal to an intersection RF modem included in an intersection preemption unit coupled with an intersection system controller. The head may be mounted to a traffic support fixture. The wakeup optical receiver, the wakeup circuit, the preemption optical receiver, and the head RF modem may all be operably coupled together within the head. The intersection preemption unit may be adapted to change a traffic light in favor of the vehicle to which the vehicle preemption unit is mounted in response to the optical signal from the vehicle preemption unit.

Second implementations of a wireless head may include one, all, or any of the following:

A battery may be included adapted to provide substantially all the power to operate the wireless head.

A solar panel may be included coupled with the wireless head, where the solar panel is adapted to supply a portion of the power to operate the wireless head.

The wireless head may include a head controller coupled with the wakeup circuit and the one or more wakeup optical receivers where the head controller is adapted to enter an operating state from a low power state in response to receiving the wakeup signal from the wakeup controller. The head controller may further include a signal process and a signal decoder where the signal processor is adapted to condition and process the optical signal and the signal decoder is adapted to determine the presence of the optical signal or to decode the optical signal to produce information relating to the vehicle.

A red light sensor may be included and may be coupled with the wireless head where the red light sensor is adapted to detect when a red light included in a traffic light mounted on the traffic support fixture is illuminated.

A temperature sensor, a light level sensor, a wind speed sensor, a humidity sensor, or any combination thereof may be coupled with the wireless head.

At least a second wireless head may be included and may be adapted to receive the optical signal and to calculate a distance of the vehicle from an intersection by triangulating using the optical signal.

The wireless head may include at least a second optical receiver adapted to receive the optical signal and to calculate a distance of the vehicle from an intersection by triangulating using the optical signal.

Third implementations of a wireless head may include one or more optical receivers or one or more head radio transceivers adapted to identify and receive an optical signal or a radio signal, respectively, transmitted by an optical transmitter or a vehicle radio transceiver included in a vehicle preemption unit mounted to a vehicle. The one or more optical receivers or one or more head radio transceivers may be coupled with a wakeup circuit including a wakeup controller adapted to transmit a wakeup signal when the optical signal or radio signal is identified. A head controller may be coupled with the wakeup circuit and the one or more optical receivers or head radio transceivers and adapted to enter an operating state from a low power state in response to the wakeup signal from the wakeup controller. The head controller may further include a signal processor and a signal decoder where the signal processor is adapted to condition and process the optical signal or the radio signal and the signal decoder is adapted to determine the presence of the optical signal or the radio signal or to decode the optical signal or the radio signal to produce information relating to the vehicle. A head radio frequency (RF) modem may be coupled with the head controller and adapted to transmit one or more radio signals corresponding with the optical signal or the radio signal to an intersection RF modem included in an intersection preemption unit coupled with an intersection system controller. An on-board power source may be coupled with the head controller, the on-board power source adapted to supply substantially all of the power needed to operate the head. The head may be mounted to the traffic support fixture. The intersection preemption unit may be adapted to change a traffic light in favor of the vehicle to which the vehicle preemption unit is mounted in response to the optical signal from the vehicle preemption unit.

Implementations of wireless heads and traffic preemption systems disclosed in this document may utilize implementations of a method of forwarding a traffic preemption signal using a wireless head to an intersection controller. Implementations of the method may include identifying an optical signal using one or more optical receivers included in a wireless head coupled to a traffic support fixture where the optical signal is transmitted by an optical transmitter included in a vehicle preemption unit mounted to a vehicle, the optical signal adapted to indicate the presence of the vehicle. The method may also include transmitting a wakeup signal in response to the optical signal, the wakeup signal transmitted to a head controller using a wakeup controller included in a wakeup circuit included in the wireless head. The wakeup signal may be adapted to cause the head controller to enter an operating state from a low power state in response to the wakeup signal. The method may include receiving the optical signal from the optical transmitter of the vehicle preemption unit using the one or more optical receivers coupled with the head controller. The method may also include transmitting one or more radio signals corresponding with the received optical signal using a head radio frequency (RF) modem where the one or more radio signals are transmitted to an intersection RF modem include in an intersection preemption unit coupled with an intersection system controller. The intersection preemption unit may be adapted to change a traffic light in favor of the vehicle to which the vehicle preemption unit is mounted in response to the one or more radio signals. The method may include receiving a confirmation radio signal from the intersection RF modem in response to receiving the one or more radio signals from the head RF modem where the confirmation radio signal is adapted to indicate successful receipt of the one or more radio signals transmitted by the head RF modem and powering the one or more optical receivers, the head controller, and the head RF modem using a battery.

Implementations of a method of forwarding a traffic preemption signal may include one, all, or any of the following:

Receiving the optical signal from the optical transmitter of the vehicle preemption unit using one or more optical receivers coupled with the head controller may further include identifying the presence of the optical signal and the amplitude of the optical signal without decoding or interpretation of the optical signal using the head controller. Transmitting one or more radio signals corresponding with the optical signal from the vehicle may further include transmitting one or more radio signals adapted to communicate the presence of the optical signal, the amplitude of the optical signal, and information relating to the operating status of the wireless head to the intersection RF modem.

Receiving the optical signal from the optical transmitter of the vehicle preemption unit using one or more optical receivers coupled with the head controller may further include identifying the amplitude of the optical signal without decoding or interpretation of the optical signal using the head controller. Transmitting one or more radio signals corresponding with the optical signal from the vehicle may further include transmitting one or more radio signals modulated similarly to a modulation of the optical signal and adapted to communicate the amplitude of the optical signal and information relating to the operating status of the wireless head to the intersection RF modem.

Receiving the optical signal from the optical transmitter of the vehicle preemption unit using one or more optical receivers coupled with the head controller may further include decoding and interpreting the optical signal with the head controller to produce a request, command, instruction, status, information, data, or any combination thereof. Transmitting one or more radio signals corresponding with the optical signal from the vehicle may further include transmitting one or more radio signals including the request, command, instruction, status, information, data, or any combination thereof to the intersection RF modem.

Transmitting one or more radio signals corresponding with the optical signal from the vehicle may further include relaying the information included in the optical signal with one or more radio signals to one of the intersection RF modem, another intersection RF modem, another vehicle, a central control system, one or more wireless heads, and any combination thereof.

Transmitting one or more radio signals corresponding with the optical signal from the vehicle using the head RF modem may further include measuring the amplitude of the optical signal, comparing the amplitude with a predetermined threshold, and transmitting one or more radio signals corresponding with the optical signal from the vehicle using a head RF modem if the amplitude is equal to or greater than the predetermined threshold.

Transmitting one or more radio signals corresponding with the optical signal from the vehicle using the head RF modem may further include continuing to transmit the one or more radio signals at a higher amplitude, a staggered time, a dithered time, a different channel, a frequency hopping pattern, a frequency hopping code, an error control coding technique, or any combination thereof.

The method may further include transmitting one or more timing radio signals using the intersection RF modem to two or more wireless heads located at an intersection where the one or more timing radio signals are adapted to allow the two or more wireless heads to transmit one or more radio signals using their respective head RF modems at different times to prevent signal collision.

Transmitting one or more radio signals corresponding with the optical signal using the head RF modem may further include utilizing a listen before transmit protocol prior to transmitting the one or more radio signals and transmitting the one or more radio signals during a clear time.

Transmitting one or more radio signals corresponding with the optical signal from the vehicle using the head RF modem may further include transmitting one or more radio signals including a distance the vehicle is from an intersection where the distance of the vehicle from the intersection is determined by optically triangulating using multiple wireless heads or multiple optical receivers included in the wireless head.

Transmitting one or more radio signals corresponding with the optical signal from the vehicle using the head RF modem may further include transmitting one or more radio signals when the vehicle is within a predetermined distance from an intersection where the distance of the vehicle from the intersection is determined by optically triangulating using multiple wireless heads or multiple optical receivers included in the wireless head.

The method may further include determining the status of a traffic light mounted to the traffic support fixture by using a red light sensor coupled with the system controller and coupled with the traffic light. The method may also include transmitting one or more radio signals using the head RF modem to the intersection preemption unit that includes the status of the traffic light.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended wireless head and/or assembly procedures for a wireless head will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such wireless heads and implementing components, consistent with the intended operation.

Figure 1:
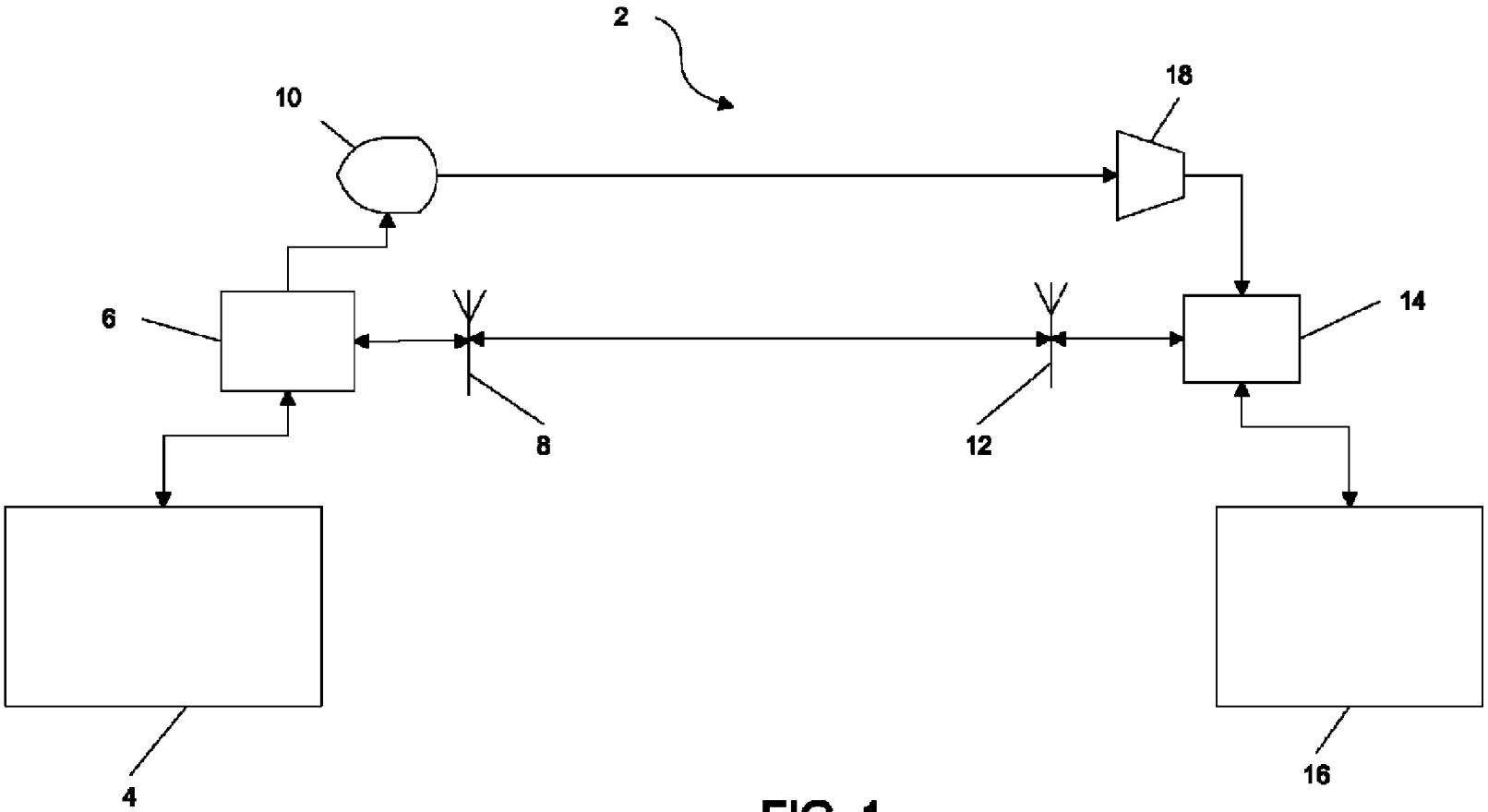
FIG. 1 is a block diagram of an implementation of a traffic preemption system.

Referring to FIG. 1, a block diagram of an implementation of a traffic preemption system 2 is illustrated. As illustrated, the system 2 includes a vehicle 4 to which is mounted a vehicle preemption unit 6. The vehicle 4 may be any land, air, or water vehicle, and in particular implementations may include, but is not limited to, an emergency vehicle, such as a police car, fire engine, or ambulance, or a high priority non-emergency vehicle, such as a city transit vehicle or a dignitary vehicle. The vehicle preemption unit 6 includes a vehicle radio transceiver coupled with an antenna 8 and an optical transmitter 10. The radio transceiver is adapted to communicate bidirectionally via radio signals sent using the antenna 8 with a corresponding antenna 12 of an intersection radio transceiver included in an intersection preemption unit 14 coupled with an intersection system controller 16. The intersection system controller 16 may be any of a wide variety of conventional traffic light controllers and may be located in any of a wide variety of locations at or near an intersection (such as on the ground adjacent to the sidewalk on one corner of the intersection).

The optical transmitter 10 is adapted to communicate unidirectionally with an optical receiver 18 included in the intersection preemption unit. The optical transmitter 10 and optical receiver 18 are adapted to send and receive any of a wide variety of optical signals using an optical communication pattern. Examples of optical communication patterns include by non-limiting example, strobed optical signals, optical signals with a defined pattern, optical signals with a particular radiation frequency or amplitude, or any other type of optical signal. Optical signals with a particular radiation frequency include optical signals that are transmitted using various frequencies of light, and, correspondingly, different light colors (visible, ultraviolet, infrared, etc.). In particular implementations, only optical signals may be used to transmit identifying information regarding the vehicle 4 to the intersection preemption unit 14; in others, only radio signals may be used, and in others, a combination of optical signals and radio signals may be employed.

Figure 2:
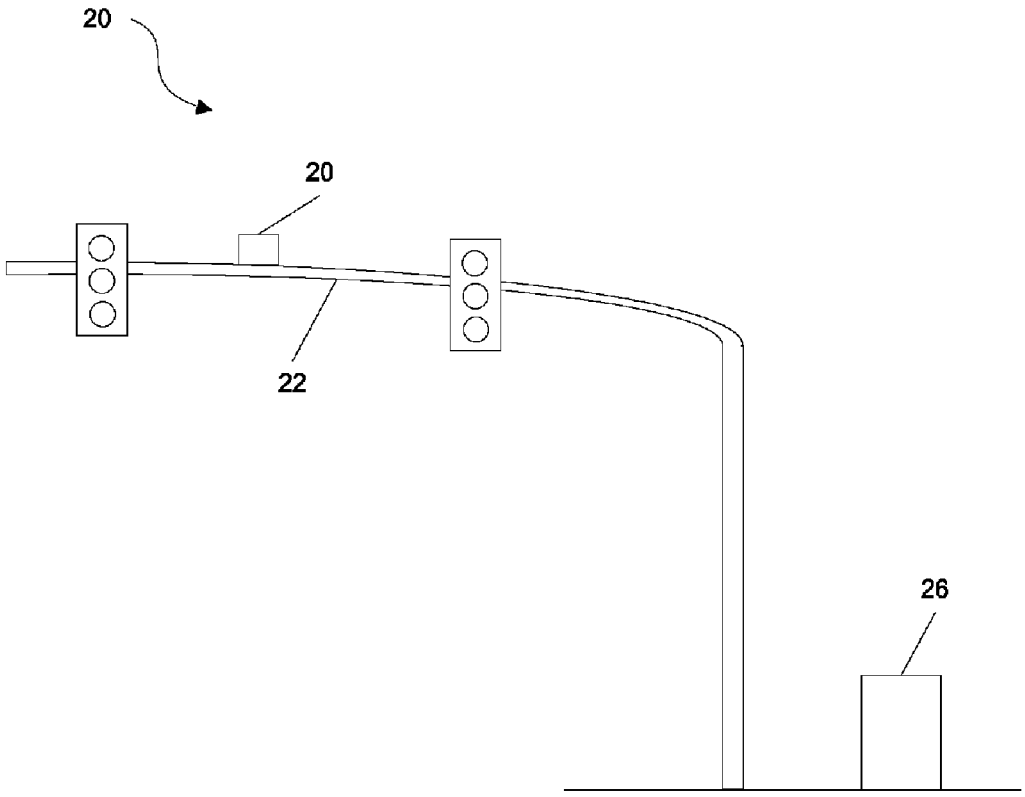
FIG. 2 is a front view of an implementation of a wireless head mounted to a traffic support fixture.

In implementations of traffic preemption systems 2, the optical receiver 18 and the intersection radio transceiver may be incorporated either singly or in combination in a wireless head mounted to a traffic support fixture. In other implementations of traffic preemption systems 2, the optical receiver 18 and/or a head radio transceiver may be included in the wireless head and the intersection radio transceiver may be included with the intersection system controller 26. Referring to FIG. 2, an implementation of a traffic preemption system 20 is illustrated that includes wireless head 22 mounted to traffic support fixture 24. The traffic support fixture 24 is located at an intersection and the wireless head 22 is in communication with an intersection preemption unit included with intersection system controller 26, also located at the intersection. In particular implementations, one or more wireless heads may be mounted to the same traffic support fixture 24. As used in this document, a traffic support fixture includes both traffic-related and non-traffic related poles, masts, supports, cables, or other systems and/or structures in or around a traffic intersection that are capable of supporting a traffic light and/or a wireless head. In addition, particular implementations of wireless heads may be mounted on cables extending over part of the intersection. Because no wires may be required for installation of a wireless head (as it may be powered using a battery and/or one or more solar power sources), the cost and time required to install implementations of wireless heads on existing infrastructure may be greatly reduced relative to a wired equivalent. In addition, the number of places at an intersection at which the wireless head may be installed may be much greater than are available with wired solutions. Also, the dimensions of implementations of wireless heads may be more flexible because the wireless head is no longer required to couple directly to the structure of any particular support. The potential number of potential components that may be included in implementations of wireless heads may also be much larger.

Figure 3:
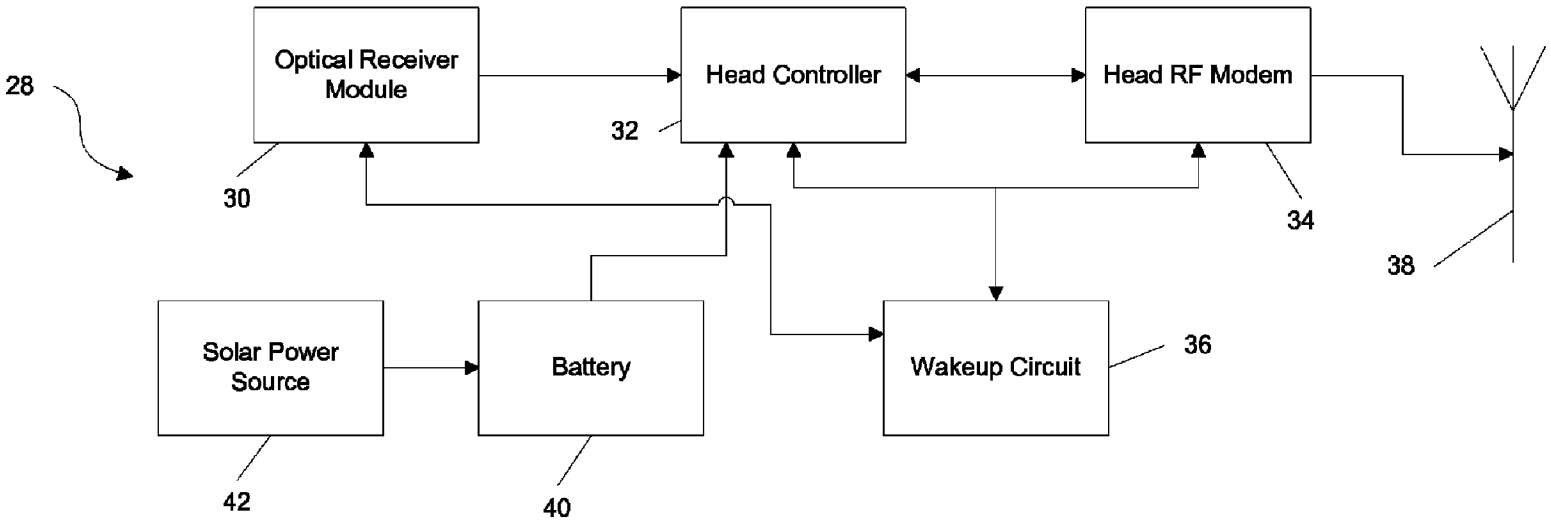
FIG. 3 is a block diagram of an implementation of a wireless head.

Referring to FIG. 3, a block diagram of an implementation of a wireless head 28 is illustrated. As illustrated, the wireless head 28 may include an optical receiver module 30 coupled with a head controller 32 and a head radio frequency (RF) modem 34. In particular implementations, the optical receiver module 30 may be configured to include an optical receiver that operates in a low power continuous "sleep" state and adapted to receive incoming optical signals. If a received optical signal has a predetermined characteristic, then the optical receiver may send the received optical signal to the head controller 32 for processing. In other particular implementations, the optical receiver module 30 may include a wakeup optical receiver and an optical receiver, where the wakeup optical receiver is adapted to receive incoming optical signals in a low power state. When a conforming optical signal is recognized by the wakeup optical receiver, the optical receiver may be activated by the wakeup optical receiver (turned on or brought from a low power state to an operating state) and used to receive the optical signal and to send it as a corresponding electronic signal to the head controller 32 for processing. In other particular implementations, the wakeup optical receiver may receive the optical signal and send it directly to the head controller 32 for processing while the head controller 32 activates the optical receiver if the processing indicates the signal corresponds to the desired parameters.

As illustrated in FIG. 3, in particular implementations of wireless heads 28, a wakeup circuit 36 may be included that is coupled with one, some, or all of the components of the wireless head 28. As illustrated, the wakeup circuit 36 may receive the optical signals from the optical receiver module 30 from either the wakeup optical receiver or the optical receiver, depending upon the implementation. In particular implementations, the wakeup circuit 36 may include a low power processor adapted to receive the optical signal, process it, and determine whether the optical signal corresponds with any of a wide variety of predetermined signal characteristics. In other implementations, the wakeup circuit 36 may serve to route the optical signal to the head controller 32 for processing. In these implementations, the wakeup circuit may wakeup the head controller 32 to process the signal, or head controller 32 may be capable of operating in a low power and in an operating state and of processing the optical signal in either state. The wakeup circuit 36 may be adapted to wake up, or move from a low power or off state to an operating or on state, any or all of the components in the wireless head 28 in response to an indication from the head controller 32 or the lower power processor in the wakeup circuit 36 that the optical signal received has the predetermined signal characteristics. The wakeup circuit 36 may also have, in particular implementations, the capability to shut down any or all of the components in the wireless head 28 after optical signals of the desired characteristics are no longer being received for a given period of time, thereby aiding in the conservation of power.

In particular implementations, the optical receiver module 30 may include a head radio transceiver adapted to receive one or more radio signals sent from a vehicle approaching the intersection. In particular implementations, as with the optical receivers, a wakeup radio receiver may be included in addition to the head radio receiver. The wakeup radio receiver may perform substantially the same function as the wakeup optical receiver by being adapted to receive a radio signal and to either activate the head radio receiver if the radio signal corresponds with certain predetermined characteristics, or to send the received radio signal to the controller 32 and/or the wakeup circuit 36 for further processing. Also in particular implementations, as was described with the optical receiver, the head radio transceiver may be adapted to operate in a lower power state without a wakeup radio receiver and to forward the received radio signal to the head controller 32 and/or the wakeup circuit 36 for processing or a determination of whether the received radio signal corresponds with any of a wide variety of desired signal characteristics. Any of a wide variety of combinations of wakeup optical receivers, optical receivers, wakeup radio receivers, and head radio transceivers are possible using the principles disclosed in this document.

As illustrated in FIG. 3, the head controller 32 is coupled with head RF modem 34, which is adapted to receive processed optical and/or radio signals from the head controller 32 and to relay or transmit them to an intersection RF modem coupled with an intersection preemption unit coupled with an intersection controller. As illustrated, the head RF modem 34 may utilize an antenna 38 in the relay or transmission process. The head RF modem 34 and antenna 38 may be adapted to transmit radio signals in a wide variety of frequencies and formats, including, by non-limiting example, a single frequency, spread-spectrum, narrowband, wideband, or other radio frequency or format. The antenna 38 may be external to the wireless head 28 or may be included within a housing in which all of the components of the wireless head 28 are located.

Also as illustrated in FIG. 3, a battery 40 is coupled with the various components of the wireless head 28 and supplies the power necessary to operate the head 28. The battery may be any of a wide variety of conventional types and may be rechargeable or non-rechargeable. In particular implementations, the battery 40 may be able to last 15 years depending upon the power consumption of the various components in the wireless head 28. When the battery 40 is rechargeable, external power sources, such as one or more solar power sources 42, may be utilized to charge the battery during the day. In particular implementations, the one or more solar power sources 42 may supply enough power to power the various components in the wireless head 28 during the day without requiring any battery input. At night, the various components are then run from battery power. Implementations of wireless heads 28 may include the capability to send battery power status information to the intersection preemption unit via the head RF modem 34 as well as a wide variety of other information about the operating status of the wireless head 28. In particular implementations of wireless heads 28, a battery may not be included, but any of a wide variety of on-board power sources that are self-contained and supply substantially all the power to the wireless head needed for operation may be used, such as, by non-limiting example, solar power sources, mechanical energy recovery sources, wind power sources, vibration energy recovery sources, sources capable of recovering energy from the motion of the wireless head on the traffic light support, and any other system capable of producing substantially all of the power needed to run the head without contribution from an external power-containing wire.

Implementations of wireless heads 28 may include a wide variety of other components and sensors. In particular implementations, a red light sensor may be included and coupled with the head controller 32. The red light sensor may be positioned within view of the red light of a traffic light mounted to the same traffic support fixture to which the wireless head 28 is coupled. The red light sensor may provide an input to the head controller 32 when the red light is lit on the traffic light and the head controller 32 may communicate this status to the intersection preemption unit thereby providing additional input into the traffic preemption process. In addition, a wide variety of other components may be included, including, by non-limiting example, temperature sensors, light level sensors, wind speed sensors, humidity sensors, still cameras, video cameras, or any other desired component. Information from these components may be transferred to the intersection preemption unit or to, by non-limiting example, a central traffic control system, another intersection, another vehicle, a meteorology system, or any other information gathering system.

Figure 4:
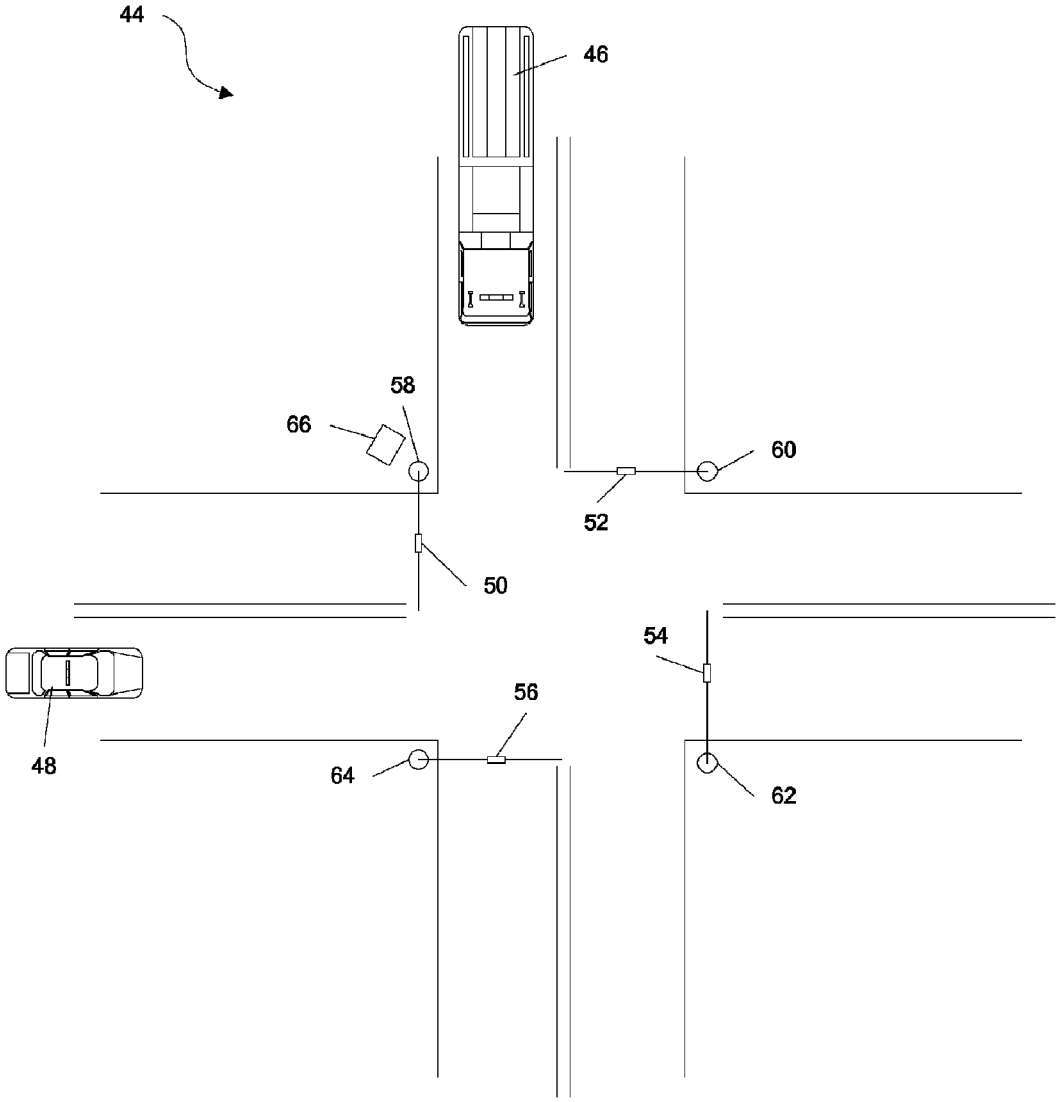
FIG. 4 is a diagram of an intersection with two vehicles approaching.

Referring to FIG. 4, a diagram of an intersection 44 is illustrated showing fire engine 46 and police car 48 approaching. Wireless heads 50, 52, 54, and 56 are mounted to traffic support fixtures 58, 60, 62, and 64. Each of the wireless heads 50, 52, 54, and 56 is in communication with an intersection preemption unit coupled to intersection controller 66. During operation, vehicle preemption units mounted in each of fire engine 46 and police car 48 transmit an optical signal, a radio signal, or both an optical and radio signal toward the intersection 44 which is subsequently detected by wireless heads 56 and 54, respectively. The optical receivers and/or radio transceivers in wireless heads 56 and 54 receive the transmitted signals and pass them with or without additional processing to the head RF modems in each head. The head RF modems then transmit the received signals to an intersection RF modem coupled with the intersection preemption unit which is coupled with the intersection system controller 66. The intersection preemption unit then processes the received signals and determines how and which traffic light should be preempted based in part on the information included in the received signal.

Because the wireless heads 50, 52, 54, and 56 may not be coupled with any power-carrying wiring while in operation, a battery power source may be utilized to provide substantially all of the power needed to operate the various components included in the wireless head. Because long periods may pass before the wireless heads 50, 52, 54, and 56 may actually be activated in an emergency situation, the wireless heads 50, 52, 54, and 56 may utilize implementations of wakeup circuits and/or additional optical receivers and/or radio transceivers to monitor incoming signals while allowing many of the components of the wireless head to operate in a low power state. In these implementations, the signals being sent from the police car 48 and fire engine 46 may be first detected at a low sampling rate and then analyzed to determine whether the signals are strong enough and/or contain proper characteristics consistent with a genuine preemption signal prior to waking up the wireless heads 56 and 54, respectively, to begin additional processing. If the signal strength and/or formatting are proper, then the wakeup circuits in the wireless heads 56 and 54 send wakeup signals to head controllers within the wireless heads 56 and 54 which transition from a low power state to an operating state, wake up the rest of the components of the wireless heads, and begin receiving and/or processing of the transmitted signals. Depending upon the implementation, the signals received by the wireless heads 56 and 54 may be processed, decoded, analyzed, or relayed prior to being sent to the head RF modems for transmission to the intersection preemption unit.

When the wireless heads 50, 52, 54, and 56 include head radio transceivers, additional functionality may be possible. For example, in particular implementations, when wireless head 56 receives the signal from fire engine 46, it may notify the other wireless heads 50, 52, and 54 that it has received such a signal directly via its head RF modem. This notification may replace or complement a similar notification from the intersection RF modem from the intersection preemption unit. In other particular implementations, the functionality of the intersection preemption unit may be largely performed by one or a combination of the wireless heads 50, 52, 54, and 56 acting in concert via a network and/or individually to process received signals and transmit traffic light preemption requests to an intersection RF modem coupled with the intersection system controller 66. In other particular implementations, the signal received by any or all of the wireless heads 50, 52, 54, and 56 may be relayed using their respective head RF modems to another wireless head at another intersection, another intersection RF modem at another intersection, a central traffic control system, another vehicle, the police car 48, or any other desired system. In some implementations, the police car 48 and/or fire engine 46 may be involved in the signal relaying process and may act as relays to intersections within radio and/or optical signal range.

Also, while the intersection 44 illustrates only a single wireless head mounted to traffic support fixtures 58, 60, 62, and 64, in particular implementations, more than one wireless head may be mounted to the same traffic support fixture. In these implementations, the heads may be mounted on the same or adjacent traffic support fixtures and angled relative to each other from about 90 to about 180 degrees relative to each other. The heads may be mounted across the intersection from each other and may in particular implementations, be spaced between about 50 feet to about 300 feet from each other. The relative angling enable each wireless head to participate in ascertaining the distance of the fire engine 46 or the police car 48 from the intersection at the time of receipt of the signals from each using a triangulation method. Representative examples of conventional triangulation methods for optical and radio signals that could be used in implementations of such wireless heads include U.S. Pat. No. 6,549,058 to Bondarev entitled "Signal Processing Circuits for Multiplication or Division of Analog Signals and Optical Triangulation Distance Measurement System and Method of Incorporating Same," issued Apr. 15, 2003 and U.S. Pat. No. 4,454,583 to Scheiderhan et al. entitled "Navigation System," issued Jun. 12, 1984, the relevant disclosures of which are hereby incorporated herein by reference. In some implementations, wireless heads used for triangulation may be mounted on different traffic support fixtures and angled relative to each other within the above mentioned range. In other particular implementations, each wireless head may include one or more optical receivers and/or head radio transceivers that are configured to permit distance determination using triangulation. In some implementations, the spacing of the optical receivers and/or head radio transceivers in the wireless head may be like that of a pair of binoculars where the two devices are relatively close to each other. The use of multiple receivers/transceivers within the same head may permit the reuse of substantial portions of the internal electronics of the wireless head, allowing for coverage of multiple traffic directions with a single head and/or reduction of costs. Multiple optical receiver and/or radio transceiver wireless head implementations may also be utilized in implementations of traffic preemption systems that include multiple wireless heads mounted to each traffic support fixture.

Figure 5:
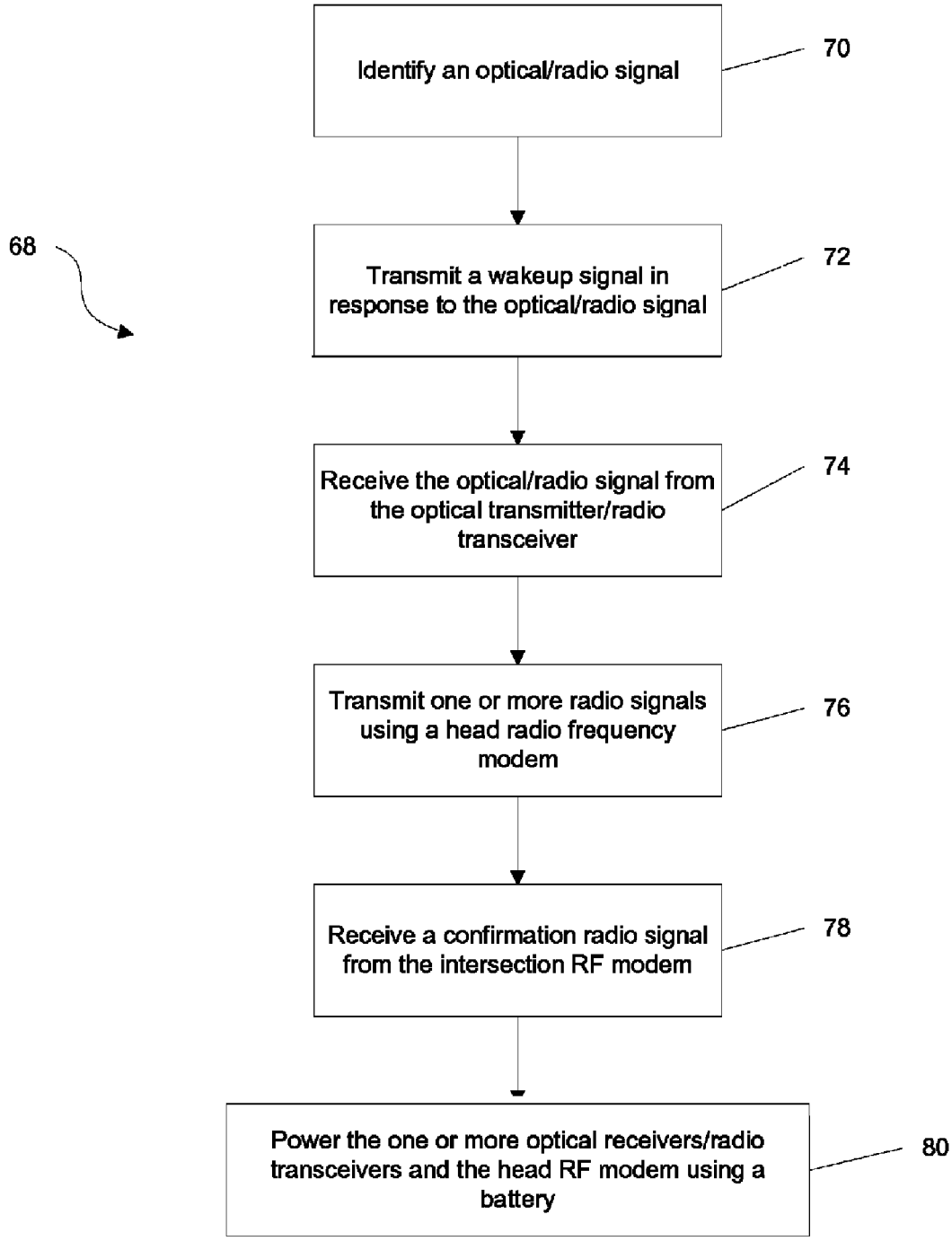
FIG. 5 is a flow chart of an implementation of a method of forwarding a traffic preemption signal using a wireless head to an intersection controller.

Referring to FIG. 5, a flow chart of an implementation of a method of forwarding a traffic preemption signal using a wireless head to an intersection controller 68 is illustrated. As illustrated, the method includes identifying an optical signal (or radio signal) using one or more optical receivers (or head radio transceivers) included in a wireless head coupled to a traffic support fixture where the optical signal (or radio signal) is transmitted by an optical transmitter (or vehicle radio transceiver) included in a vehicle preemption unit mounted to a vehicle and adapted to indicate the presence of the vehicle (step 70). The method 68 also includes transmitting a wakeup signal in response to the optical (or radio) signal where the wake up signal is transmitted to a head controller using a wakeup controller included in a wakeup circuit included in the wireless head. The wakeup signal is adapted to cause the head controller to enter an operating state from low power state in response to the wakeup signal (step 72). The method also includes receiving the optical (or radio) signal from the optical transmitter (or vehicle radio transceiver) of the vehicle preemption unit using the one or more optical receivers (or the one or more head radio transceivers) coupled with the head controller (step 74). The method 68 includes transmitting one or more radio signals corresponding with the received optical (or radio) signal using a head RF modem where the one or more radio signals are transmitted to an intersection RF modem included in an intersection preemption unit coupled with an intersection system controller. The intersection preemption unit is adapted to change a traffic light in favor of the vehicle to which the vehicle preemption unit is mounted in response to the one or more radio signals (step 76). The method 68 also includes receiving a confirmation radio signal from the intersection RF modem in response to receiving the one or more radio signals from the head RF modem where the confirmation radio signal is adapted to indicate successful receipt of the one or more radio signals transmitted by the head RF modem (step 78) and powering the one or more optical receivers (or one or more head radio transceivers), the head controller, and the head RF modem using a battery (step 80).

A wide variety of implementations of the method 68 are possible. Particular implementations may be designed for optical signals, but similar implementations may utilize radio signals only. Other implementations may utilize both radio signals and optical signals. In particular implementations, the presence and amplitude of the optical signal may be determined by the head controller and no further decoding or interpretation of the optical signal may be performed. In these implementations, the one or more radio signals transmitted by the head RF modem may include the presence and amplitude information. In other implementations, the amplitude and modulation of the optical signal may be determined by the head controller and no further decoding or interpretation of the optical signal may be performed. The one or more radio signals transmitted by the head RF modem may be modulated similarly to the modulation of the optical signal and may contain information relating to the amplitude of the optical signal.

In other implementations, the head controller may decode and interpret the received optical signal and produce a request, command, instruction, status, information, data or any combination of the foregoing that is being communicated via the optical signal. In these implementations, a corresponding request, command, instruction, status, information, data, or any combination of the foregoing is transmitted by the head RF modem to the intersection preemption unit. In other implementations, the one or more radio signals sent by the head RF modem to the intersection preemption unit may be a relay of the received optical signal with changes in format, medium, and amplitude without any additional processing, decoding, or information gathering being done with the received optical signal.

In particular implementations, transmission of the one or more radio signals by the head RF modem may take place if one of the properties of the optical signal is greater than a threshold value. For example, implementations of the method 68 may include measuring the amplitude of the optical signal, comparing the amplitude with a predetermined threshold value, and transmitting the one or more radio signals using the head RF modem if the amplitude is equal to or greater than the predetermined threshold value. Similar steps could be implemented for any other property of the optical signal or of a radio signal such as, by non-limiting example, frequency, noise, intensity, peak power, pulse width or any other characteristic of an optical or radio signal.

In particular implementations, after the head RF modem has transmitted the one or more radio signals, it may continue to transmit the one or more radio signals at a higher amplitude, a staggered time, a dithered time, on a different channel, using a frequency hopping pattern, using a frequency hopping code, using an error control coding technique, or with any combination of the foregoing. This retransmission of the one or more radio signals may occur by default for a predetermined amount of time, or in particular implementations, may continue until the confirmation signal from the intersection preemption unit has been received by the head RF modem.

In implementations of traffic preemption systems with two or more wireless heads present at an intersection, the method 68 may include transmitting one or more timing radio signals using the intersection RF modem to the two or more wireless heads. The head controllers and/or the head RF modems may then utilize the one or more timing radio signals to ensure that each wireless head transmits to the intersection RF modem at a different time (by way of a different time or other calculation), thus reducing the likelihood of signal collisions. In other implementations, the head RF modems themselves may utilize a listen before transmit transmission method that ensures that prior to transmission, each head RF modem determines whether any radio transmission is occurring prior to transmitting, ensuring that during transmission of their one or more radio signals, the transmission takes place during a clear time.

As was discussed previously in this document, implementations of traffic preemption systems may utilize wireless heads to determine a distance to an incoming vehicle from the intersection and then transmit that information to the intersection RF modem for use by the intersection preemption unit. In these implementations, multiple wireless heads mounted to the same traffic support fixture (or coupled therewith) may be used; in other implementations, wireless heads with multiple optical receivers and/or multiple radio transceivers could also be used. Any of a wide variety of conventional triangulating methods using optical, radio, or both optical and radio signals, including those disclosed in this document, may be utilized in particular implementations.

Because implementations of wireless heads disclosed in this document may operate without any wired connection with the intersection controller, the wireless head may need to gather information about the actual status of the traffic lights at the intersection at any given time. This may be necessary to permit the wireless head to determine what command or other signal to send to the intersection preemption unit via the head RF modem or may be used as part of a safety check to ensure that the light has actually changed from red to green. In these cases, implementations of the method 68 may determine the status of a traffic light mounted to the same traffic support fixture (or a different fixture in particular implementations) by using a red light sensor coupled with the sensor controller and with the traffic light. Information relating to the sensor output may be included in the transmission of one or more radio signals by the head RF modem to the intersection preemption unit. The intersection preemption unit and/or the wireless head may then utilize the information in the traffic preemption process.

As was previously mentioned, each of the foregoing implementations of the method 68 described in the foregoing paragraphs can analogously be implemented using radio signals or a combination of both radio and optical signals.

Figure 6:
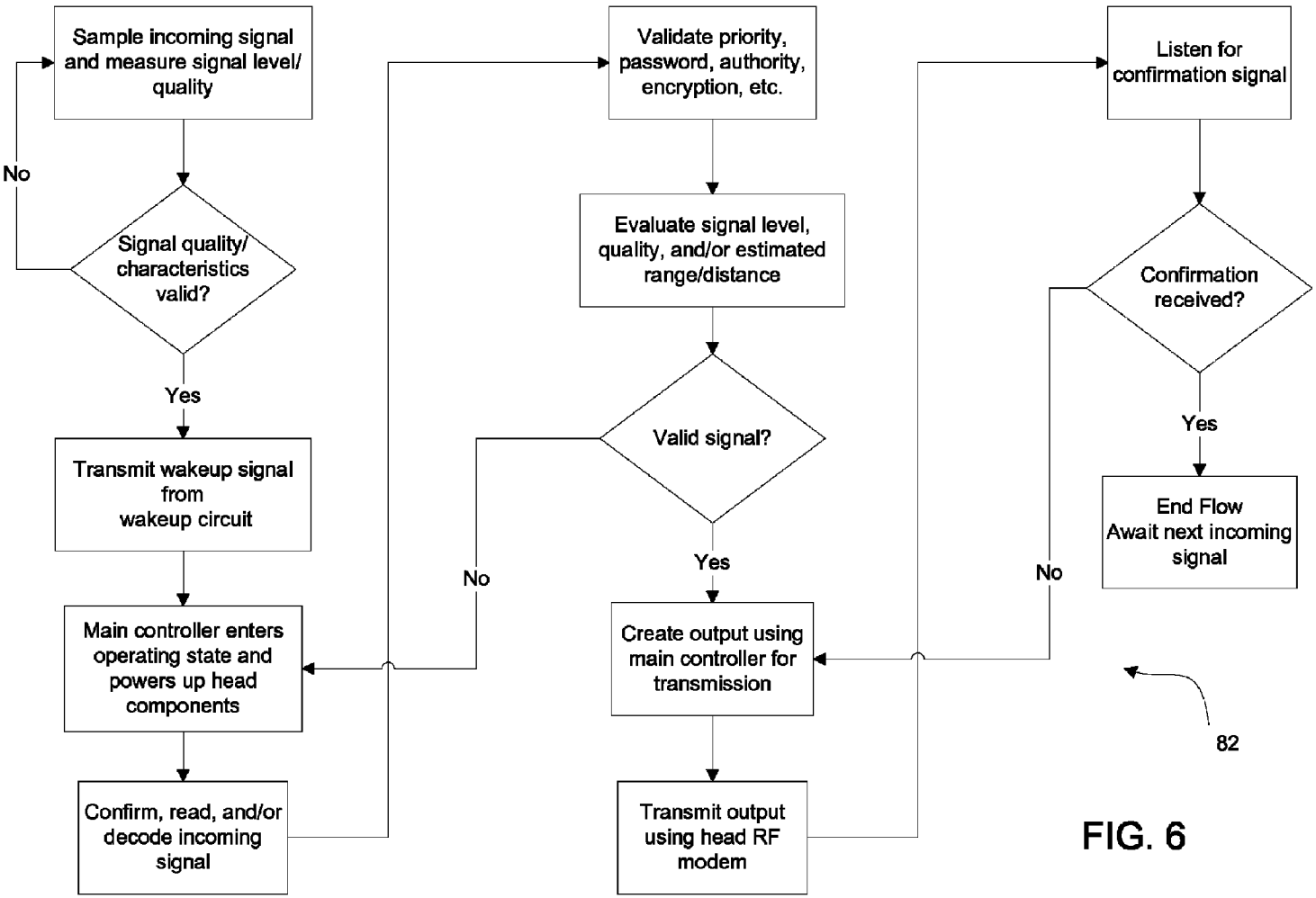
FIG. 6 is a flow chart of another implementation of a method of forwarding a traffic preemption signal using a wireless head to an intersection controller.

Referring to FIG. 6, another implementation of a method of forwarding a traffic preemption signal using a wireless head to an intersection controller 82 is illustrated. As illustrated, the method 82 begins with a preemption optical receiver or optical receiver (or a preemption radio transceiver or head radio transceiver) identifying an incoming signal by sampling the incoming signal to measure signal level and/or quality as well as characteristics of the signal, such as, by non-limiting example, the signal's frequency, amplitude, pulse width, or any other optical or radio signal characteristic. For the exemplary purposes of this disclosure, the sampling process may occur using a wakeup optical receiver or optical receiver operating under low power conditions at a sampling rate of about ten samples per second. A wakeup circuit containing a wakeup controller is used to analyze the samples to determine whether the quality, level, and other characteristics are either sufficient or match desired values. If the values are insufficient or do not match, then the sampling continues; otherwise, a wakeup signal is transmitted from the wakeup circuit to the head controller of the wireless head. For example if two light pulses are detected within a particular time frame, such as 120 milliseconds, the wakeup controller may generate a wakeup signal to the head controller.

Upon receipt of the wake up signal, and as illustrated in FIG. 6, the main controller enters an operating state from a low power state and then proceeds to wake the rest of the components of the wireless head. On a periodic basis, in some implementations, every 10 seconds, the main controller may wake all or some of the components of the wireless head in order to make sensor readings, perform self tests, communicate various status indicators to the intersection preemption unit, and do other tasks. Once the wireless head components have woken, the optical receiver (or head radio transceiver) begins to receive the optical signal (or radio signal) and to process it using the head controller.

The head controller includes a signal processor and a signal decoder in particular implementations. The signal processor may condition and process the optical signal (or the radio signal) to determine various characteristics of the signal (such as amplitude, frequency, pulse rate, etc.) and the signal decoder may analyze the resulting signal to produce decoded information relating to the vehicle sending the signal. The head controller accordingly may confirm, read, and/or decode the incoming signal and may analyze information contained in the signal to validate priority, one or more passwords, jurisdictional or other authority, encryption information, or any other characteristic contained in the signal information that enables a decision about the validity of the source of the signal. The head controller may also evaluate the signal level, quality, and/or estimated range or distance of the vehicle to make an initial decision regarding whether signal is from an approaching vehicle and/or whether the approaching vehicle is close enough to warrant starting the traffic preemption process. With this information, the head controller makes the decision whether the signal being received is a valid signal or not. If not, the head controller may keep the various components of the head powered up and continue to analyze the signal as illustrated in FIG. 6; alternatively, the head controller may power down the various components of the head and re-enter the low power state while waiting for another wakeup signal from the wakeup circuit.

If a valid signal is detected, the head controller may create output that contains information relating to the signal using any of the various methods disclosed in this document (relaying, transmitting presence and amplitude, decoding, etc.). The output may be transmitted to the head RF modem and sent in the form of one or more radio signals in any radio signal format, including, by non-limiting example, Wireless Fidelity (WiFi) certified signals, 802.11b, 802.11g, 802.11n, 802.11a, Worldwide Interoperability for Microwave Access (WIMAX), cellular telephone signals, or any other radio frequency signal. The output may be transmitted to the intersection RF modem and to a central traffic control, monitoring, and/or tracking system or any other desired system, wireless head, or vehicle. The output may take the form of packetized data communications where a wide variety of data may be communicated within the data payload of the packet or in a wide number of optional header fields carrying information relating to the vehicle, such as, by non-limiting example, the vehicle's angle, speed, direction, turn signal status, jurisdiction, priority, or any other desired characteristic.

Once the one or more radio signals have been transmitted to at least the intersection RF modem, the head RF modem may continue transmitting as has been previously described in this document using various additional transmission techniques, or the head RF modem may wait for a confirmation or acknowledgement signal to be received from the intersection RF modem confirming that the intersection RF modem received the one or more radio signals. If the confirmation is not received within a certain period of time, the method 82 may include recreating the output and resending the one or more radio signals. If the confirmation is received, then the method operations have been completed for the optical or radio signal just received; in various implementations, the method may be repeated for each received optical or radio signal, or for various aggregations of received optical or radio signals, depending upon how much information is communicated in each optical or radio signal.

Implementations of wireless heads disclosed in this document may regularly, or on request, transmit one or more radio signals that communicate an operating condition or status of the wireless head. The intersection preemption unit can also accomplish testing, self testing, calibration, verification of signal transmit power or other characteristics, and any other desired function through engaging in scheduled or ad hoc communication with the wireless head(s) through the head RF modem.

The foregoing method illustrates how implementations of the method may utilize optical and/or radio signals. Other particular implementations may be adapted to use similar, parallel steps to simultaneously or serially process both received optical signals and received radio signals. A wide variety of implementations are possible using the principles disclosed in this document. For example, while the implementations disclosed in this document have been illustrated in the context of traffic lights at intersections, the principles may be utilized in many other use conditions, such as in shopping centers, universities, and military bases and in access control applications at gates controlling entrances to particular areas within or places within a facility or industrial complex. Some implementations may be utilized as full communication services, where entire voice, data, or video information is transmitted using implementations of the systems as part of the access or preemption process or as a means of facilitating secure communications.

In particular implementations of wireless heads and related method implementations disclosed in this document, the radio and/or optical signals have been transmitted primarily between the vehicle and the wireless head and between the wireless head and the vehicle. In particular implementations of the system, the vehicle may communicate via wireless and/or optical signals primarily with the intersection preemption unit. In these implementations, the wireless head may listen to the radio and/or optical signals coming from the vehicle or may ignore them and wait for signals from the intersection preemption unit. In implementations where the wireless head listens to the radio and/or optical signals from the vehicle, the wireless head may track values of the Received Signal Strength Indication (RSSI). In these implementations, the RSSI values may be utilized to perform optical and/or radio triangulation with the intersection preemption unit and/or the vehicle to determine the distance of the vehicle from the intersection. In some implementations, the vehicle itself may be involved in the triangulation process by providing to the intersection preemption unit and/or the wireless head distance estimates based on an initial guess (using all in-range devices and RSSI and/or previously known intersection metrics). In particular implementations both optical RSSI and radio RSSI values may be used to perform the triangulation.

In some implementations, while radio and/or optical signals may be received and processed by the wireless head at some stages or steps of the communication between the vehicle and the intersection preemption unit, at other stages or steps (linking, authentication, session ending etc.) the wireless head may not be involved at other stages. Where the wireless head merely listens to or ignores the radio and/or optical signals coming from the vehicle, battery power may be conserved and/or optimized, since the wireless head will not be required to expend power by being involved in the receipt of and relaying of received signals with the intersection preemption unit.

In places where the description above refers to particular implementations of wireless heads, it should be readily apparent that a number of modifications may be made without departing from the spirit thereof and that these implementations may be applied to other wireless head implementations.

The invention claimed is:

1. A wireless head for a traffic preemption system comprising:

one or more optical receivers adapted to identify an optical signal transmitted by an optical transmitter comprised in a vehicle preemption unit mounted to a vehicle;

one or more head radio transceivers adapted to identify a radio signal transmitted by a vehicle radio transceiver comprised in the vehicle preemption unit; and a head radio frequency (RF) modem adapted to transmit one or more radio signals corresponding with one of the optical signal, the radio signal, and a combination of the optical signal and the radio signal to an intersection RF modem included in an intersection preemption unit coupled with an intersection system controller;

wherein the head is mounted to a traffic support fixture;

wherein the one or more optical receivers, one or more head radio transceivers, and the head RF modem are all operably coupled together within the wireless head; and wherein the intersection preemption unit is adapted to change a traffic light in favor of the vehicle to which the vehicle preemption unit is mounted in response to one of the optical signal, the radio signal, and the combination of the optical signal and the radio signal from the vehicle preemption unit.

2. The wireless head of claim 1, further comprising a battery adapted to provide substantially all the power to operate the wireless head.

3. The wireless head of claim 1, further comprising a solar panel coupled with the wireless head, the solar panel adapted to supply a portion of the power to operate the wireless head.

4. The wireless head of claim 1, further comprising:

one or more wakeup optical receivers coupled with a wakeup circuit comprising a wakeup controller, the one or more wakeup optical receivers adapted to identify and receive the optical signal and the wakeup controller adapted to transmit a wakeup signal when the optical signal is identified;

one or more wakeup radio receivers coupled with the wakeup circuit, the one or more wakeup radio receivers adapted to identify and receive the radio signal and the wakeup controller adapted to transmit a wakeup signal when the radio signal is identified; and a head controller coupled with the wakeup circuit and the one or more wakeup optical receivers and the one or more wakeup radio receivers, the head controller adapted to enter an operating state from a low power state in response to receiving the wakeup signal from the wakeup controller, the head controller further comprising a signal processor and a signal decoder, the signal processor adapted to condition and process the optical signal and the radio signal and the signal decoder adapted to determine the presence of the optical signal and the radio signal or to decode the optical signal and the radio signal to produce information relating to the vehicle.

5. The wireless head of claim 1, further comprising:

a wakeup circuit coupled with the one or more optical receivers, the wakeup circuit comprising a wakeup controller, the one or more optical receivers and the wakeup circuit adapted to identify and receive the optical signal and to transmit a wakeup signal when the optical signal is identified;

wherein the wakeup circuit is further coupled with the one or more radio receivers and the one or more radio receivers and the wakeup circuit are adapted to identify and receive the radio signal and to transmit a wakeup signal when the radio signal is identified; and a head controller coupled with the wakeup circuit and the one or more optical receivers and the one or more radio receivers, the head controller adapted to enter an operating state from a low power state in response to receiving the wakeup signal from the wakeup controller, the head controller further comprising a signal processor and a signal decoder, the signal processor adapted to condition and process the optical signal and the radio signal and the signal decoder adapted to determine the presence of the optical signal and the radio signal or to decode the optical signal and the radio signal to produce information relating to the vehicle.

6. The wireless head of claim 1, further comprising a red light sensor coupled with the wireless head, the red light sensor adapted to detect when a red light included in a traffic light mounted on the traffic support fixture is illuminated.

7. The wireless head of claim 1, further comprising one of a temperature sensor, a light level sensor, a wind speed sensor, a humidity sensor, and any combination thereof coupled with the wireless head.

8. The wireless head of claim 1, further comprising at least a second wireless head adapted to receive the optical signal and the radio signal and to calculate a distance of the vehicle from an intersection by triangulating using one of the optical signal, the radio signal, and a combination of the optical signal and the radio signal.

9. The wireless head of claim 1, further comprising at least a second optical receiver or a second head radio transceiver adapted to receive the optical signal or the radio signal, respectively, and to calculate a distance of the vehicle from an intersection by triangulating using the optical signal or the radio signal.

10. A wireless head for a traffic preemption system comprising:

a wakeup optical receiver adapted to identify an optical signal transmitted by an optical transmitter comprised in a vehicle preemption unit mounted to a vehicle, the optical receiver coupled with a wakeup circuit comprising a wakeup controller;

a preemption optical receiver adapted to receive the optical signal from the optical transmitter of the vehicle preemption unit; and a head radio frequency (RF) modem adapted to transmit one or more radio signals corresponding with the optical signal to an intersection RF modem included in an intersection preemption unit coupled with an intersection system controller;

wherein the head is mounted to a traffic support fixture;

wherein the wakeup optical receiver, the wakeup circuit, the preemption optical receiver, and the head RF modem are all operably coupled together within the head; and wherein the intersection preemption unit is adapted to change a traffic light in favor of the vehicle to which the vehicle preemption unit is mounted in response to the optical signal from the vehicle preemption unit.

11. The wireless head of claim 10, further comprising a battery adapted to provide substantially all the power to operate the wireless head.

12. The wireless head of claim 10, further comprising a solar panel coupled with the wireless head, the solar panel adapted to supply a portion of the power to operate the wireless head.

13. The wireless head of claim 10, further comprising:

a head controller coupled with the wakeup circuit and the one or more wakeup optical receivers, the head controller adapted to enter an operating state from a low power state in response to receiving the wakeup signal from the wakeup controller, the head controller further comprising a signal processor and a signal decoder, the signal processor adapted to condition and process the optical signal and the signal decoder adapted to determine the presence of the optical signal or to decode the optical signal to produce information relating to the vehicle.

14. The wireless head of claim 10, further comprising a red light sensor coupled with the wireless head, the red light sensor adapted to detect when a red light included in a traffic light mounted on the traffic support fixture is illuminated.

15. The wireless head of claim 10, further comprising one of a temperature sensor, a light level sensor, a wind speed sensor, a humidity sensor, and any combination thereof coupled with the wireless head.

16. The wireless head of claim 10, further comprising at least a second wireless head adapted to receive the optical signal and to calculate a distance of the vehicle from an intersection by triangulating using the optical signal.

17. The wireless head of claim 10, further comprising at least a second optical receiver adapted to receive the optical signal and to calculate a distance of the vehicle from an intersection by triangulating using the optical signal.

18. A wireless head for a traffic preemption system comprising:

one or more optical receivers or one or more head radio transceivers adapted to identify and receive an optical signal or a radio signal, respectively, transmitted by an optical transmitter or a vehicle radio transceiver comprised in a vehicle preemption unit mounted to a vehicle, the one or more optical receivers or one or more head radio transceivers coupled with a wakeup circuit comprising a wakeup controller adapted to transmit a wakeup signal when the optical signal or radio signal is identified;

a head controller coupled with the wakeup circuit and the one or more optical receivers or head radio transceivers and adapted to enter an operating state from a low power state in response to the wakeup signal from the wakeup controller, the head controller further comprising a signal processor and a signal decoder, the signal processor adapted to condition and process the optical signal or the radio signal and the signal decoder adapted to determine the presence of the optical signal or the radio signal or to decode the optical signal or the radio signal to produce information relating to the vehicle;

a head radio frequency (RF) modem coupled with the head controller and adapted to transmit one or more radio signals corresponding with the optical signal or the radio signal to an intersection RF modem included in an intersection preemption unit coupled with an intersection system controller; and an on-board power source coupled with the head controller, the on-board power source adapted to supply substantially all of the power needed to operate the head;

wherein the head is mounted to the traffic support fixture; and wherein the intersection preemption unit is adapted to change a traffic light in favor of the vehicle to which the vehicle preemption unit is mounted in response to the optical signal from the vehicle preemption unit.

19. A method of forwarding a traffic preemption signal using a wireless head to an intersection controller comprised in a traffic preemption system, the method comprising:

identifying an optical signal using one or more optical receivers included in a wireless head coupled to a traffic support fixture, the optical signal transmitted by an optical transmitter comprised in a vehicle preemption unit mounted to a vehicle and adapted to indicate the presence of the vehicle;

transmitting a wakeup signal in response to the optical signal, the wakeup signal transmitted to a head controller using a wakeup controller included in a wakeup circuit included in the wireless head, the wakeup signal adapted to cause the head controller to enter an operating state from a low power state in response to the wakeup signal;

receiving the optical signal from the optical transmitter of the vehicle preemption unit using the one or more optical receivers coupled with the head controller;

transmitting one or more radio signals corresponding with the received optical signal using a head radio frequency (RF) modem, the one or more radio signals transmitted to an intersection RF modem included in an intersection preemption unit coupled with an intersection system controller, the intersection preemption unit adapted to change a traffic light in favor of the vehicle to which the vehicle preemption unit is mounted in response to the one or more radio signals;

receiving a confirmation radio signal from the intersection RF modem in response to receiving the one or more radio signals from the head RF modem, the confirmation radio signal adapted to indicate successful receipt of the one or more radio signals transmitted by the head RF modem; and powering the one or more optical receivers, the head controller, and the head RF modem using a battery.

20. The method of claim 19, wherein receiving the optical signal from the optical transmitter of the vehicle preemption unit using one or more optical receivers coupled with the head controller further comprises identifying the presence of the optical signal and the amplitude of the optical signal without decoding or interpretation of the optical signal using the head controller, and wherein transmitting one or more radio signals corresponding with the optical signal from the vehicle further comprises transmitting one or more radio signals adapted to communicate the presence of the optical signal, the amplitude of the optical signal, and information relating to the operating status of the wireless head to the intersection RF modem.

21. The method of claim 19, wherein receiving the optical signal from the optical transmitter of the vehicle preemption unit using one or more optical receivers coupled with the head controller further comprises identifying the amplitude of the optical signal without decoding or interpretation of the optical signal using the head controller, and wherein transmitting one or more radio signals corresponding with the optical signal from the vehicle further comprises transmitting one or more radio signals modulated similarly to a modulation of the optical signal and adapted to communicate the amplitude of the optical signal and information relating to the operating status of the wireless head to the intersection RF modem.

22. The method of claim 19, wherein receiving the optical signal from the optical transmitter of the vehicle preemption unit using one or more optical receivers coupled with the head controller further comprises decoding and interpreting the optical signal with the head controller to produce one of a request, command, instruction, status, information, data, and any combination thereof, and wherein transmitting one or more radio signals corresponding with the optical signal from the vehicle further comprises transmitting one or more radio signals comprising one of the request, command, instruction, status, information, data, and any combination thereof to the intersection RF modem.

23. The method of claim 19, wherein transmitting one or more radio signals corresponding with the optical signal from the vehicle further comprises relaying the information comprised in the optical signal with one or more radio signals to one of the intersection RF modem, another intersection RF modem, another vehicle, a central control system, one or more wireless heads, and any combination thereof.

24. The method of claim 19, wherein transmitting one or more radio signals corresponding with the optical signal from the vehicle using the head RF modem further comprises:

measuring the amplitude of the optical signal;

comparing the amplitude with a predetermined threshold; and transmitting one or more radio signals corresponding with the optical signal from the vehicle using a head RF modem if the amplitude is equal to or greater than the predetermined threshold.

25. The method of claim 19, wherein transmitting one or more radio signals corresponding with the optical signal from the vehicle using the head RF modem further comprises continuing to transmit the one or more radio signals at one of a higher amplitude, a staggered time, a dithered time, a different channel, a frequency hopping pattern, a frequency hopping code, an error control coding technique, and any combination thereof.

26. The method of claim 19, further comprising transmitting one or more timing radio signals using the intersection RF modem to two or more wireless heads located at an intersection, the one or more timing radio signals adapted to allow the two or more wireless heads to transmit one or more radio signals using their respective head RF modems at different times to prevent signal collision.

27. The method of claim 19, wherein transmitting one or more radio signals corresponding with the optical signal from the vehicle using the head RF modem further comprises utilizing a listen before transmit protocol prior to transmitting the one or more radio signals and transmitting the one or more radio signals during a clear time.

28. The method of claim 19, wherein transmitting one or more radio signals corresponding with the optical signal from the vehicle using the head RF modem further comprising transmitting one or more radio signals comprising a distance the vehicle is from an intersection wherein the distance of the vehicle from the intersection is determined by optically triangulating using multiple wireless heads or multiple optical receivers comprised in the wireless head.

29. The method of claim 19, wherein transmitting one or more radio signals corresponding with the optical signal from the vehicle using the head RF modem further comprises transmitting one or more radio signals when the vehicle is within a predetermined distance from an intersection wherein the distance of the vehicle from the intersection is determined by optically triangulating using multiple wireless heads or multiple optical receivers comprised in the wireless head.

30. The method of claim 19, further comprising:

determine the status of a traffic light mounted to the traffic support fixture by using a red light sensor coupled with the system controller and coupled with the traffic light; and transmitting one or more radio signals using the head RF modem to the intersection preemption unit that include the status of the traffic light.

* * * * *